US008723595B1

(12) United States Patent
Chen

(10) Patent No.: US 8,723,595 B1
(45) Date of Patent: May 13, 2014

(54) VOLTAGE GENERATOR

(71) Applicant: ISSC Technologies Corp., Hsinchu (TW)

(72) Inventor: Yi-Lung Chen, Hsinchu (TW)

(73) Assignee: ISSC Technologies Corp., Hsinchu (TW)

( * ) Notice: Subject to any disclaimer, the term of this patent is extended or adjusted under 35 U.S.C. 154(b) by 0 days.

(21) Appl. No.: 13/769,830

(22) Filed: Feb. 19, 2013

(51) Int. Cl.
*G05F 1/10* (2006.01)

(52) U.S. Cl.
USPC ..... 327/539; 327/538

(58) Field of Classification Search
USPC ..... 327/539, 530, 538, 540, 541, 542, 543, 327/560, 561, 562, 563
See application file for complete search history.

(56) References Cited

U.S. PATENT DOCUMENTS 7,224,210 B2 5/2007 Garlapati et al.
7,286,002 B1 * 10/2007 Jackson ..... 327/539
7,915,947 B2 3/2011 Liu et al.
2007/0052473 A1 3/2007 McLeod
2008/0224682 A1 * 9/2008 Haiplik ..... 323/313
2009/0096510 A1 * 4/2009 Ogiwara et al. ..... 327/539
2011/0169561 A1 * 7/2011 Chu et al. ..... 327/539

* cited by examiner

*Primary Examiner* — Lincoln Donovan
*Assistant Examiner* — Jung H Kim
(74) *Attorney, Agent, or Firm* — Jianq Chyun IP Office

(57) ABSTRACT

The voltage generator provided by the present invention includes: a first current source, a second current source, a first resistor, a reference voltage generator, a first amplifier and a second amplifier. The first current source generates a first current and a second current with a first temperature coefficient according to a first bias voltage. The second current source generates a third current and a fourth current with a second temperature coefficient according to a second bias voltage. The reference voltage generator provides a first reference voltage and a second reference voltage according to the first and third currents. The first amplifier generates the first bias voltage according to the first and second reference voltages. The second amplifier generates the second bias voltage according to the second and third reference voltages. Wherein, the first temperature coefficient and the second temperature coefficient are complementary.

10 Claims, 4 Drawing Sheets

VOLTAGE GENERATOR

BACKGROUND OF THE INVENTION

1. Field of Invention

The present invention generally relates to a voltage generator, and more particularly to a band gap voltage generator.

2. Description of Prior Art

A sensor technology is more and more familiar with people's life. The sensor used to sense an environment temperature could be also interesting in electronic consume device application. A precision temperature sensor in a chip within a system could gain advantages in future value-added products. Base on a band-gap voltage generator for providing a temperature independent voltage and a proportional to absolute temperature voltage. The temperature sensor in prior art compares a reference voltage VREF and a proportional to absolute temperature voltage to get temperature information. That is, it is important to design a precisely band-gap voltage generator, and such as that, the environment temperature can be precisely detected.

SUMMARY OF THE INVENTION

The present invention provides a voltage generator for generating an output voltage proportional to an environment temperature.

The voltage generator provided by the present invention includes: a first current source, a second current source, a first resistor, a reference voltage generator, a first amplifier and a second amplifier. The first current source generates a first current and a second current according to a first bias voltage, and the second current is provided to a common end. The first and second currents have a first temperature coefficient. The second current source generates a third current and a fourth current according to a second bias voltage, and the third and fourth currents have a second temperature coefficient. The first resistor has a first and second ends, the first end is coupled to the first current source for receiving the first current. The first resistor generates an output voltage on the first end. The reference voltage generator provides a first reference voltage and a second reference voltage according to the first and third currents. The first amplifier is coupled to the reference voltage generator and the first current source. The first amplifier generates the first bias voltage according to the first and second reference voltages. The second resistor is coupled between the second current source and the reference ground, and the second resistor receives the second current source for generating a third reference voltage. The second amplifier is coupled to the reference voltage generator and the second current source. The second amplifier generates the second bias voltage according to the second and third reference voltages. Wherein, the first temperature coefficient and the second temperature coefficient are complementary.

Accordingly, the voltage generator provided by present disclosure generates the output voltage according to the second current with the first temperature coefficient and the third current with the second temperature coefficient, wherein, the first and second temperature coefficients are complementary. The proposed voltage generator may reduce the device mismatch factor and the performance is promoted. Beside, the voltage generator provided by the disclosure is quite simple and save more size for reducing the prime cost.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
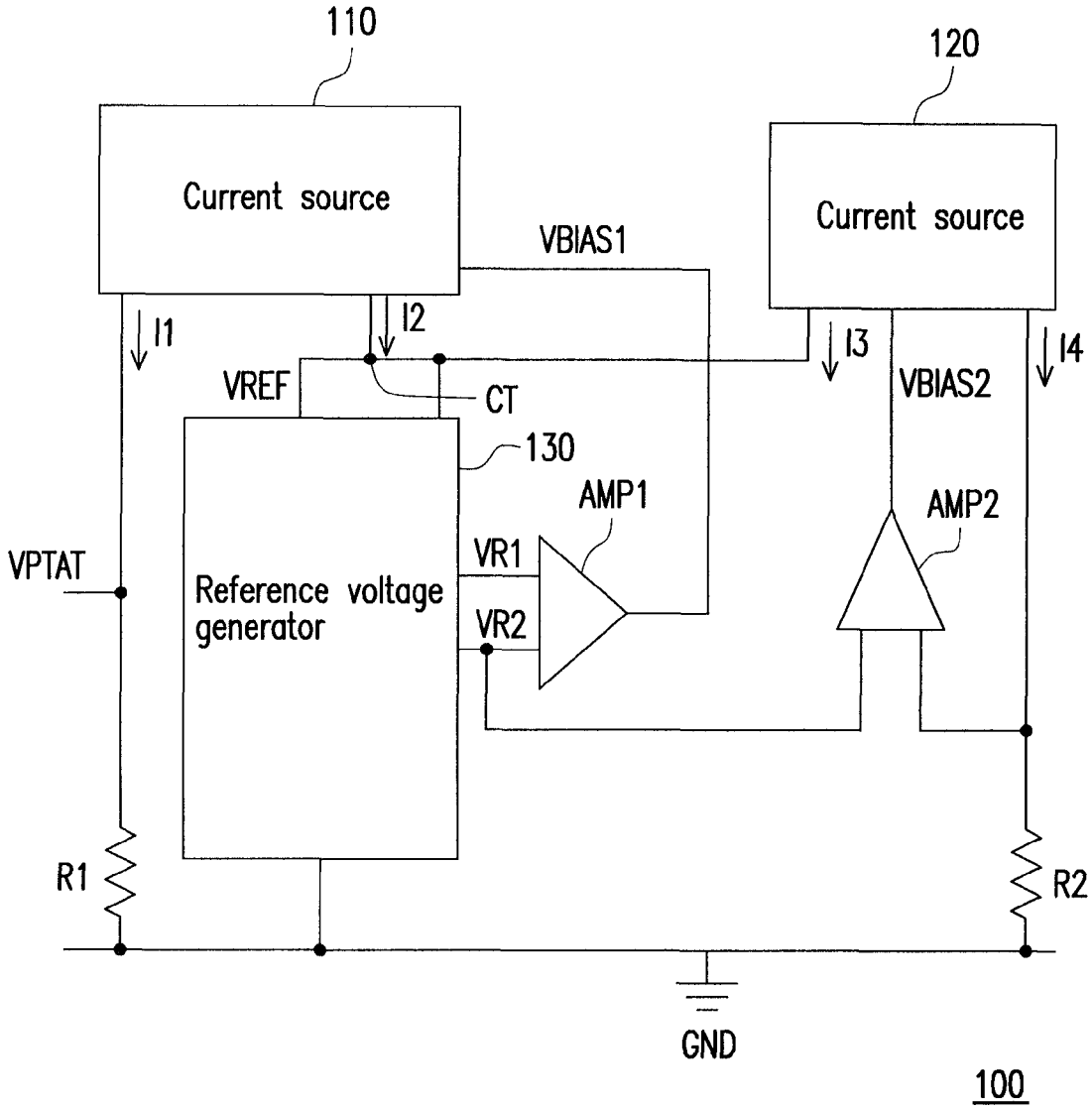
FIG. 1 is a circuit diagram of a voltage generator 100 according to an embodiment of the present invention.

Reference will now be made in detail to the present preferred embodiment of the invention, examples of which are illustrated in the accompanying drawings. Wherever possible, the same reference numbers are used in the drawings and the description to refer to the same or like parts.

Referring to FIG. 1, FIG. 1 is a circuit diagram of a voltage generator 100 according to an embodiment of the present invention. The voltage generator 100 includes a current source 110, 120, a reference voltage generator 130, resistor R1 and R2 and amplifiers AMP1 and AMP2. The current source 110 generates a first current I1 and a second current I2 according to a first bias voltage VBIAS1, and the second current I2 is provided to a common end CT, and the first and second currents I1 and 12 having a first temperature coefficient. The current source 120 is coupled to the common end CT. The current source 120 generates a third current I3 and a fourth current I4 according to a second bias voltage VBIAS2. The third current I3 is provided to the common end CT, and the third current I3 and fourth current I4 have a second temperature coefficient. Wherein, the first and the second temperature coefficient are complementary. For example, the first temperature coefficient is positive temperature coefficient, and the second temperature coefficient is negative temperature coefficient.

Since the first and the second temperature coefficient are complementary, a voltage VREF on the common end CT may be independent to the environment temperature.

The reference voltage generator 130 is coupled to the common end CT, and the reference voltage generator 130 receives the second current I2 and the third current I3 through the common end CT. Moreover, the reference voltage generator 130 generates a first reference voltage VR1 and a second reference voltage VR2 according to the second current I2 and the third current I3. The amplifier AMP1 is coupled to the reference voltage generator 130, and a first input end of the amplifier AMP1 receives the first reference voltage VR1, and a second input end of the amplifier AMP1 receives the second reference voltage VR2. The amplifier AMP1 generates the first bias voltage VBIAS1, and provides the first bias voltage VBIAS1 to the current source 110. A first input end of the amplifier AMP2 receives the second reference voltage VR2, and a second input end of the amplifier AMP2 is coupled to the connection end of the resistor R2 and the current source 120. The amplifier AMP2 generates the second bias voltage VBIAS2 according to the second reference voltage VR2 and a voltage on the connection end of the resistor R2 and the current source 120.

The resistor R1 is coupled between the current source 110 and the reference ground GND. The resistor R1 receives the first current I1 and generates the output voltage VPTAT accordingly. If the first temperature coefficient is positive temperature coefficient, a voltage level of the output voltage VPTAT is direct proportion to the environment temperature. Beside, the resistor R2 is coupled between the second input end of the amplifier AMP2 and the reference ground. The voltage level on the second input end of the amplifier AMP2 is equal to a current level of the fourth current I4 times a resistance of the resistor R2.

By adding the third current I3 which has negative temperature coefficient to the reference voltage generator 130. A slope of a relationship curve between the first current I1 and a temperature variation is increased. When the voltage generator 100 is used to be a temperature detector, a comparing action between the voltage VREF and the output voltage VPTAT is easily to be achieved. Moreover, the output voltage VPTAT can suffer less devices mismatch to gain more accuracy.

Figure 2:
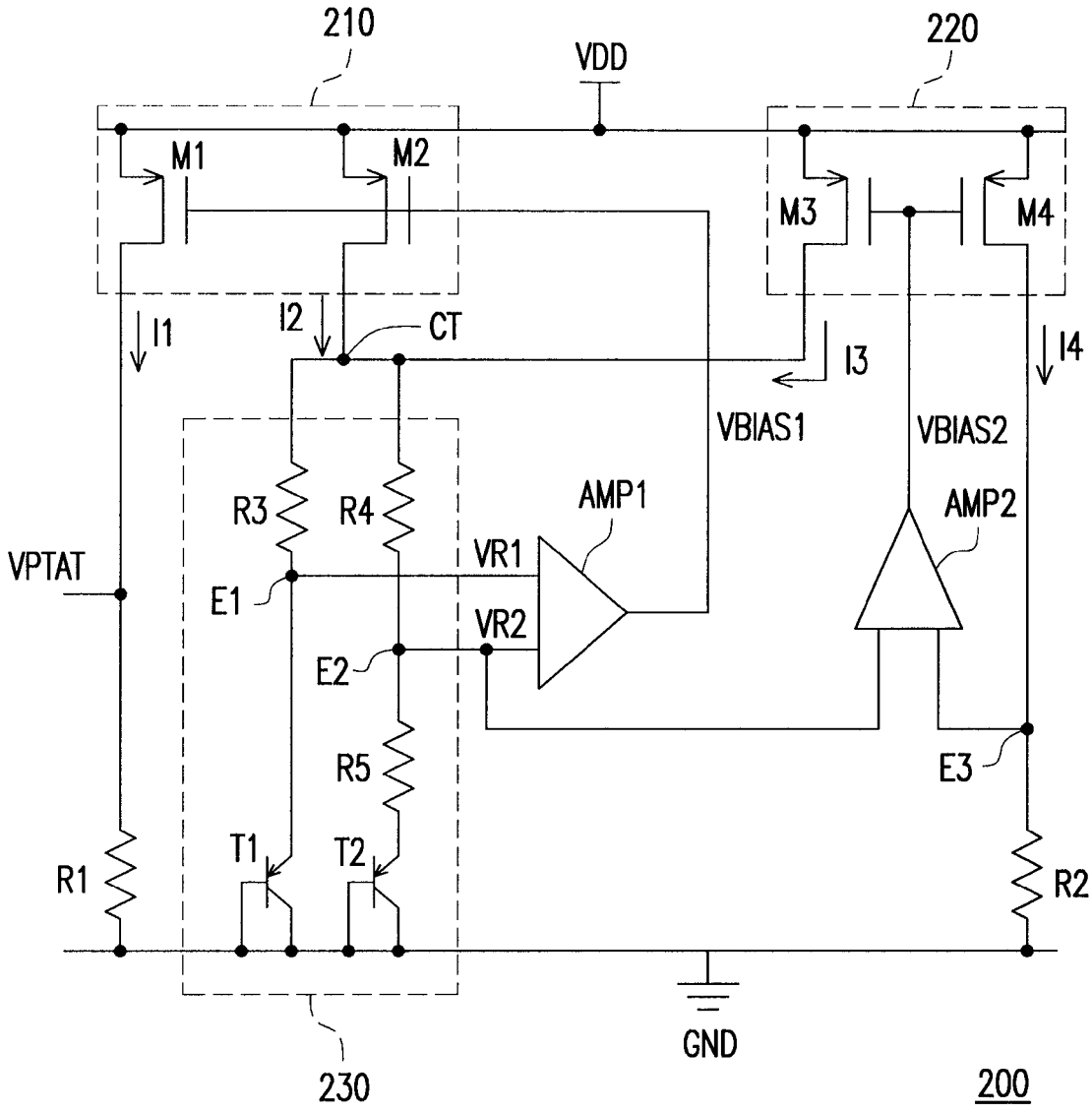
FIG. 2 is a circuit diagram of the other voltage generator 200 according to an embodiment of the present invention.

Referring to FIG. 2, FIG. 2 is a circuit diagram of the other voltage generator 200 according to an embodiment of the present invention. The voltage generator 200 includes a current source 210, 220, a reference voltage generator 230, resistor R1 and R2 and amplifiers AMP1 and AMP2. The current source 210 includes transistors M1 and M2. The first ends of the transistors M1 and M2 are coupled to a reference power VDD. The control ends of the transistors M1 and M2 are coupled to the amplifier AMP1 for receiving the first bias voltage VBIAS1. The second ends of the transistors M1 and M2 respectively generates a first current I1 and second current I2. The first current I1 is provided to the resistor R1, and the second current I2 is provided to the common end CT.

The current source 220 includes transistors M3 and M4. The control ends of the transistors M3 and M4 are coupled to the amplifier AMP2 for receiving the second bias voltage VBIAS2. The first ends of the transistors M3 and M4 are coupled to the reference power VDD. The second ends of the transistors M3 and M4 respectively generate a third current I3 and a fourth current I4. The third current I3 is provided to the common end CT, and the fourth current I4 is provided to an end E3. The end E3 is the connection end of the resistor R2, current source 220 and the amplifier AMP2.

The reference voltage generator 230 includes resistors R3, R4 and R5 and transistor T1 and T2. The resistor R3 is coupled between the common end CT and an end E1, wherein, the end E1 is coupled to a first input end of the amplifier AMP1. The resistor R1 is coupled between the common end CT and an end E2, the end E2 is coupled to a second input end of the amplifier AMP2. A first end of the resistor R5 is coupled to the end E2, and a second end of the resistor R5 is coupled to the transistor T2. A first end of the transistor T1 is coupled to the end E1, a second and a control end of the transistor T1 are coupled to the reference ground GND. A second and a control end of the transistor T2 are coupled to the reference ground GND.

The transistors T1 and T2 are configured to be diodes. The first end of the transistor T1 and T2 may be anodes of the diodes, and cathodes of the diodes are coupled to the reference ground GND.

Figure 3:
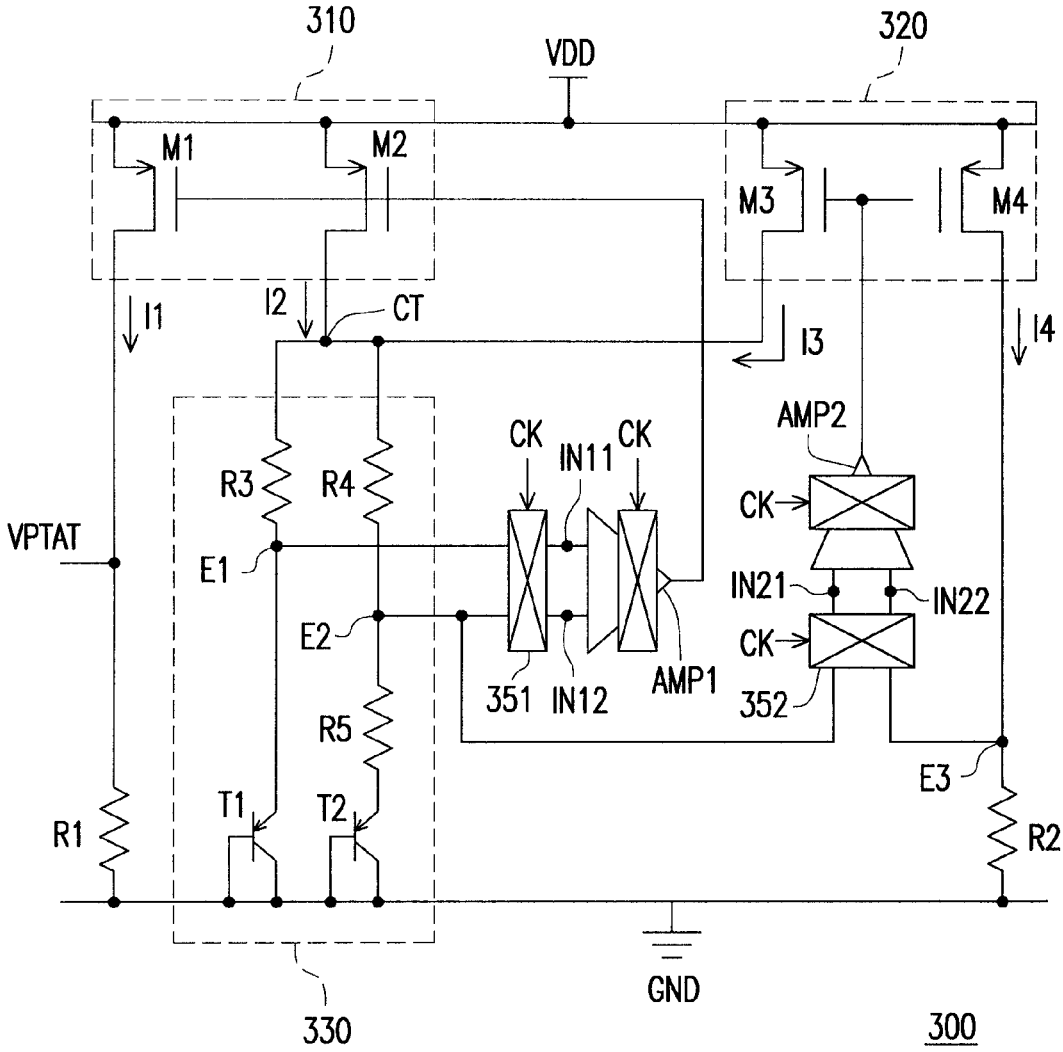
FIG. 3 is a circuit diagram of another voltage generator 200 according to an embodiment of the present invention.

Referring to FIG. 3, FIG. 3 is a circuit diagram of another voltage generator 200 according to an embodiment of the present invention. The voltage generator 300 includes a current source 310, 320, a reference voltage generator 330, resistor R1 and R2, amplifiers AMP1 and AMP2 and choppers 351 and 352. Different from the voltage generator 200, the voltage generator 300 further includes the chopper 351 and 352. The chopper 351 is coupled between the reference voltage generator 330 and the amplifier AMP1, and the chopper 352 is coupled between the amplifier AMP2 and the reference voltage generator 330. In detail, two input ends of the chopper 351 are respectively coupled to the end E1 and E2, and two output ends of the chopper 351 are respectively coupled to the first and second input ends IN11 and IN12 of the amplifier AMP1. Two input ends of the chopper 352 are respectively coupled to the end E2 and E3, and two output ends of the chopper 352 are respectively coupled to the first and second input ends IN21 and IN22 of the amplifier AMP2. The choppers 351 and 352 are respectively used to cancel the offset voltage of the amplifiers AMP1 and AMP2, and the choppers 351 and 352 are controlled by a clock signal CK.

Figure 4:
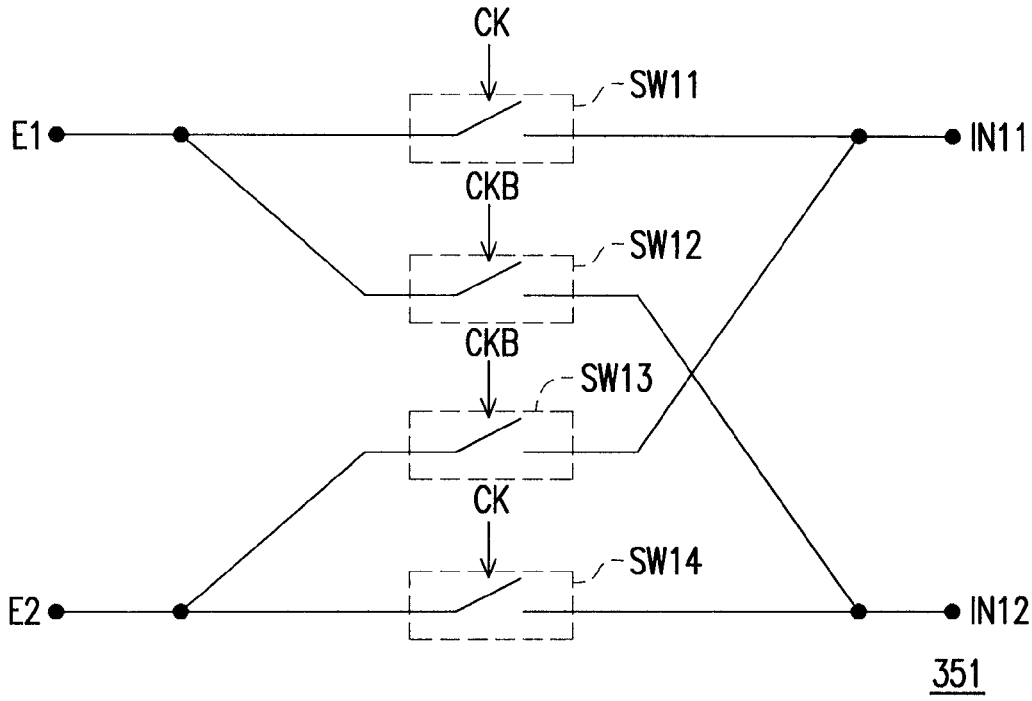
FIG. 4 is a circuit diagram of chopper 351 according to an embodiment of the present invention.

Referring to FIG. 4, FIG. 4 is a circuit diagram of chopper 351 according to an embodiment of the present invention. The chopper 351 includes switches SW11-SW14. A first end of the switch SW11 is coupled to the end E1, a second end of the switch SW11 is coupled to the first input end IN11 of the amplifier AMP1. The switch SW11 is controlled by the clock signal CK. A first end of the switch SW12 is coupled to the end E1, a second end of the switch SW12 is coupled to the second input end IN12 of the amplifier AMP1. The switch SW12 is controlled by an inversed clock signal CKB. Wherein, the clock signal CK and the inversed clock signal CKB are complementary. A first end of the switch SW13 is coupled to the end E2, a second end of the switch SW13 is coupled to the first input end IN11 of the amplifier AMP1. The switch SW13 is controlled by the inversed clock signal CKB. A first end of the switch SW14 is coupled to the end E2, a second end of the switch SW14 is coupled to the second input end IN12 of the amplifier AMP1. The switch SW14 is controlled by the clock signal CK. That is, the turned on or turned off status of the switch SW11 and SW14 are the same, the turned on or turned off status of the switch SW12 and SW13 are the same, and the turned on or turned off status of the switch SW11 and SW12 are different.

Figure 5:
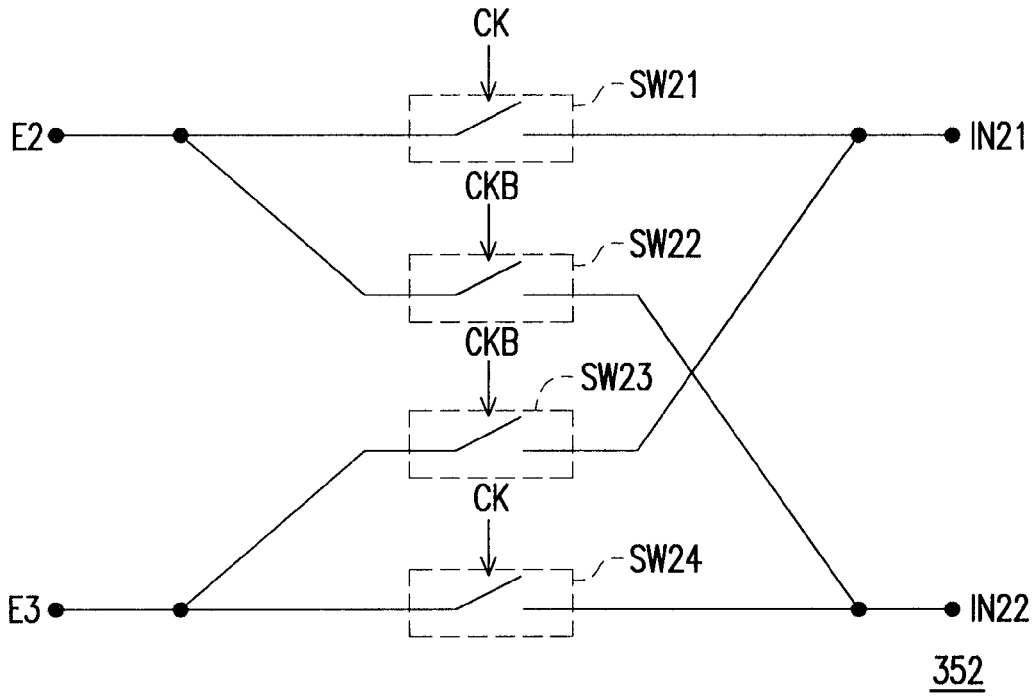
FIG. 5 is a circuit diagram of chopper 352 according to an embodiment of the present invention.

Referring to FIG. 5, FIG. 5 is a circuit diagram of chopper 352 according to an embodiment of the present invention. The chopper 352 includes switches SW21-SW24. A first end of the switch SW21 is coupled to the end E2, a second end of the switch SW21 is coupled to the first input end IN21 of the amplifier AMP2. The switch SW21 is controlled by the clock signal CK. A first end of the switch SW22 is coupled to the end E2, a second end of the switch SW22 is coupled to the second input end IN22 of the amplifier AMP2. The switch SW22 is controlled by the inversed clock signal CKB. A first end of the switch SW23 is coupled to the end E3, a second end of the switch SW23 is coupled to the first input end IN21 of the amplifier AMP2. The switch SW23 is controlled by the inversed clock signal CKB. A first end of the switch SW24 is coupled to the end E3, a second end of the switch SW24 is coupled to the second input end IN22 of the amplifier AMP2. The switch SW24 is controlled by the clock signal CK. That is, the turned on or turned off status of the switch SW21 and SW24 are the same, the turned on or turned off status of the switch SW22 and SW23 are the same, and the turned on or turned off status of the switch SW21 and SW22 are different.

To sum up the discussion above, the present disclosure provides current sources to provide currents with different temperature coefficients to the reference voltage generator. A slope of a relationship curve between the first current and a temperature variation is increased accordingly. Moreover, the output voltage can suffer less devices mismatch to gain more accuracy.

What is claimed is:

1. A voltage generator, comprising:

a first current source, generating a first current and a second current according to a first bias voltage, and the second current being provided to a common end, and the first and second currents having a first temperature coefficient;

a second current source, generating a third current and a fourth current according to a second bias voltage, and the third and fourth currents having a second temperature coefficient;

a first resistor, having a first and second ends, the first end being coupled to the first current source for receiving the first current, the first resistor generating an output voltage on the first end;

a reference voltage generator, providing a first reference voltage and a second reference voltage according to the first and third currents;

a first amplifier, coupled to the reference voltage generator and the first current source, the first amplifier generating the first bias voltage according to the first and second reference voltages;

a second resistor, coupled between the second current source and the reference ground, the second resistor receiving the second current source for generating a third reference voltage; and a second amplifier, coupled to the reference voltage generator and the second current source, the second amplifier generating the second bias voltage according to the second and third reference voltages, wherein, the first temperature coefficient and the second temperature coefficient are complementary.

2. The voltage generator according to claim 1, wherein the first current source comprises:

a first transistor, having a first end, a second end, and a control end, wherein the first end of the first transistor is coupled to a reference power, the control end of the first transistor receives the first bias voltage, and the second end of the first transistor generates the first current; and a second transistor, having a first end, a second end, and a control end, wherein the first end of the second transistor is coupled to the reference power, the control end of the second transistor receives the first bias voltage, and the second end of the second transistor is coupled to the common end.

3. The voltage generator according to claim 1, wherein the second current source comprises:

a first transistor, having a first end, a second end, and a control end, wherein the first end of the first transistor is coupled to a reference power, the control end of the first transistor receives the second bias voltage, and the second end of the first transistor generates the third current; and a second transistor, having a first end, a second end, and a control end, wherein the first end of the second transistor is coupled to the reference power, the control end of the second transistor receives the second bias voltage, and the second end of the second transistor generates the fourth current.

4. The voltage generator according to claim 1, wherein the reference voltage generator comprises:

a third resistor, coupled between the common end and a first input end of the first amplifier;

a fourth resistor, coupled between the common end and a second input end of the first amplifier;

a fifth resistor, having a first end and a second end, wherein the first end of the fifth resistor is coupled to the second input end of the first amplifier;

a first diode, wherein an anode of the first diode is coupled to the first input end of the amplifier, a cathode of the first diode is coupled to the reference ground; and a second diode, an anode of the second diode is coupled to the second end of the fifth resistor, a cathode of the second diode is coupled to the reference ground.

5. The voltage generator according to claim 4, wherein the first diode is a first transistor, and the second diode is a second transistor, the first transistor has a first end, a second end and a control end, the second end and the control end of the first transistor are coupled to the reference ground, the first end of the second transistor is coupled to the first input end of the first amplifier, the second transistor has a first end, a second end and a control end, the second end and the control end of the second transistor are coupled to the reference ground, the first end of the first transistor is coupled to the second end of the fifth resistor.

6. The voltage generator according to claim 1, further comprising:

a chopper, coupled between the first amplifier and the reference voltage generator.

7. The voltage generator according to claim 6, wherein the chopper comprises:

a first switch, wherein a first end of the first switch receives the first reference voltage, a second end of the first switch is coupled to a first input end of the first amplifier, and the first switch is controlled by a clock signal;

a second switch, a first end of the second switch receives the first reference voltage, a second end of the second switch is coupled to a second input end of the first amplifier, and the second switch is controlled by a inversed clock signal;

a third switch, a first end of the third switch receives the second reference voltage, a second end of the third switch is coupled to the first input end of the first amplifier, and the third switch is controlled by the inversed clock signal; and a fourth switch, a first end of the fourth switch receives the second reference voltage, a second end of the fourth switch is coupled to the second input end of the first amplifier, and the fourth switch is controlled by the clock signal.

8. The voltage generator according to claim 1, further comprising:

a chopper, coupled between the second amplifier and the reference voltage generator.

9. The voltage generator according to claim 8, wherein the chopper comprises:

a first switch, wherein a first end of the first switch receives the second reference voltage, a second end of the first switch is coupled to a first input end of the second amplifier, and the first switch is controlled by a clock signal;

a second switch, a first end of the second switch receives the second reference voltage, a second end of the second switch is coupled to a second input end of the second amplifier, and the second switch is controlled by a inversed clock signal;

a third switch, a first end of the third switch is coupled to the second resistor and the second current source, a second end of the third switch is coupled to the first input end of the second amplifier, and the third switch is controlled by the inversed clock signal; and a fourth switch, a first end of the fourth switch is coupled to the second resistor and the second current source, a second end of the fourth switch is coupled to the second input end of the second amplifier, and the fourth switch is controlled by the clock signal.

10. The voltage generator according to claim 1, wherein each of the first and the second amplifiers has a chopper output stage.

* * * * *